US007816845B2

(12) United States Patent
Walker, Jr.

(10) Patent No.: US 7,816,845 B2
(45) Date of Patent: Oct. 19, 2010

(54) CERAMIC ELECTRODE AND IGNITION DEVICE THEREWITH

(75) Inventor: William J. Walker, Jr., Toledo, OH (US)

(73) Assignee: Federal Mogul Ignition Company, Southfield, MI (US)

( * ) Notice: Subject to any disclaimer, the term of this patent is extended or adjusted under 35 U.S.C. 154(b) by 126 days.

(21) Appl. No.: 12/201,567

(22) Filed: Aug. 29, 2008

(65) Prior Publication Data

US 2010/0052498 A1 Mar. 4, 2010

(51) Int. Cl.
*H01T 13/20* (2006.01)

(52) U.S. Cl. ..... 313/141; 313/118

(58) Field of Classification Search ..... 313/118, 313/141

See application file for complete search history.

*Primary Examiner*—Vip Patel
(74) *Attorney, Agent, or Firm*—Robert L. Stearns; Dickinson Wright, PLLC

(57) ABSTRACT

An electrode for an ignition device is made from a conductive ceramic of the form $M_{n+1}AX_n$, where M is a transition metal, A is a group IIIA or IVA element, and X is nitrogen, carbon, or both carbon and nitrogen. M may be transition metals selected from the group of Ti, Mb, Ta, V, Cr, Mo, Sc, Zr and Hf. A may be selected from a group consisting of Al, Ga, In, Tl, Si, Ge, Sn, Pb, P, As and S. The spark ignition device may include a spark plug having an insulator, conductive shell, center electrode and ground electrode where the conductive ceramic electrode is at least one of the center or ground electrodes.

16 Claims, 2 Drawing Sheets

CERAMIC ELECTRODE AND IGNITION DEVICE THEREWITH

BACKGROUND OF THE INVENTION

1. Field of the Invention

The invention relates to a high performance electrode for a spark ignition device, and more particularly to a conductive ceramic electrode for a spark ignition device comprising a transition metal carbide, nitride or carbonnitride ceramic.

2. Related Art

A spark plug is a spark ignition device that extends into the combustion chamber of an internal combustion engine and produces a spark to ignite a mixture of air and fuel. Recent advancements in engine technology are resulting in higher engine operating temperatures to achieve improved engine efficiency. These higher operating temperatures, however, are pushing the spark plug electrodes to the very limits of their material capabilities. Presently, Ni-based alloys, including nickel-chromium-iron alloys specified under UNS N06600, such as those sold under the trade names Inconel 600®, Nicrofer 7615®, and Ferrochronin 600®, are in wide use as spark plug electrode materials.

As is well known, the resistance to high temperature oxidation of these Ni-based nickel-chromium-iron alloys decreases as their operating temperature increases. Since combustion environments are highly oxidizing, corrosive wear including deformation and fracture caused by high temperature oxidation and sulfidation can result and is particularly exacerbated at the highest operating temperatures. At the upper limits of operating temperature (e.g., 1400° F.), tensile, creep rupture and fatigue strength also have been observed to decrease significantly which can result in deformation, cracking and fracture of the electrodes. Depending on the electrode design, specific operating conditions and other factors, these high temperature phenomena may contribute individually and collectively to undesirable growth of the spark plug gap and diminished performance of the ignition device and associated engine. In extreme cases, failure of the electrode, ignition device and associated engine can result from electrode deformation and fracture resulting from these high temperature phenomena. These failure modes and effects can be particularly problematic in that they frequently occur in high performance engines, such as those used in automobile racing.

High temperature sparking tips have also been employed in conjunction with the electrode materials described above. These sparking tips have been manufactured from a number of high temperature materials including platinum group metals and metal alloys, such as platinum, iridium, rhodium, palladium, ruthenium and rhenium, as pure metals and together with themselves and various other alloy constituents, such as various rare earth elements, in various alloy combinations; gold and gold alloys; tungsten and tungsten alloys and the like. High temperature sparking tips have been attached to electrodes, including center and ground electrodes, in various tip configurations using a wide variety of attachment and joining techniques, including resistance welding, laser welding, mechanical joining and the like, both separately and in various combinations. Notwithstanding the electrode performance improvements attainable through the use of high temperature sparking tips, there remain various aspects of these materials which limit their application and use in various spark ignition device configurations and applications, such as susceptibility to other and new high temperature oxidation, erosion and corrosion mechanisms, such as those associated with small amounts of calcium and phosphorus, thermal expansion mismatch with various center and ground electrode materials and other aspects, such as the high cost of these materials, which serve to limit their usefulness in various spark ignition applications.

Accordingly, there is a need for additional high performance electrodes and electrode materials having resistance to high temperature oxidation, sulfidation and related corrosive and erosive wear mechanisms, as well as having sufficient high temperature tensile, creep rupture and fatigue strength, and resistance to cracking and fracture sufficient for use in current and future spark ignition devices.

SUMMARY OF THE INVENTION

The present invention is an electrode for a spark ignition device, including a center electrode, ground electrode, or both a center and ground electrode. The electrode is formed from a conductive ceramic material comprising a transition metal nitride, transition metal carbide, or transition metal carbonnitride of the form $M_{n+1}AX_n$, where M is a transition metal, A is a group IIIA or IVA element, and X is nitrogen, or carbon, or both carbon and nitrogen.

In another aspect, M is a transition metal selected from the group consisting of Ti, Nb, Ta, V, Cr, Mo, Sc, Zr and Hf.

In yet another aspect, A is selected from a group consisting of Al, Ga, In, Tl, Si, Ge, Sn, Pb, P, As and S.

In yet another aspect, the conductive ceramic is selected from a group consisting of $Ti_2AlC$, $Ti_2AlN$, $Ti_2Al(C_{0.5}, N_{0.5})$, $Nb_2AlC$, (Nb, Ti)AlC, $Ta_2AlC$, $V_2AlC$, $Cr_2AlC$, $Ti_4AlN_3$, $Ti_3AlC_2$ and $Ti_3SiC_2$.

In yet another aspect, the ignition device is a spark plug which includes: a generally annular ceramic insulator; a conductive shell surrounding at least a portion of the ceramic insulator; a center electrode disposed in the ceramic insulator having a terminal end and a sparking end with a center electrode sparking surface, and a ground electrode operatively attached to the shell having a ground electrode sparking surface located proximate to the center electrode sparking surface, the center electrode sparking surface and the ground electrode sparking surface providing a spark gap therebetween; wherein at least one of the center electrode or the ground electrode is the conductive ceramic electrode.

In yet another aspect, the center electrode is the conductive ceramic electrode and is disposed in the ceramic insulator by operation of a glass seal which contacts the terminal end.

BRIEF DESCRIPTION OF THE DRAWINGS

These and other aspects, features and advantages of the present invention will become more readily appreciated when considered in connection with the following detailed description of presently preferred embodiments and best mode, appended claims and accompanying drawings, in which:

DETAILED DESCRIPTION OF PRESENTLY PREFERRED EMBODIMENTS

Figure 1:
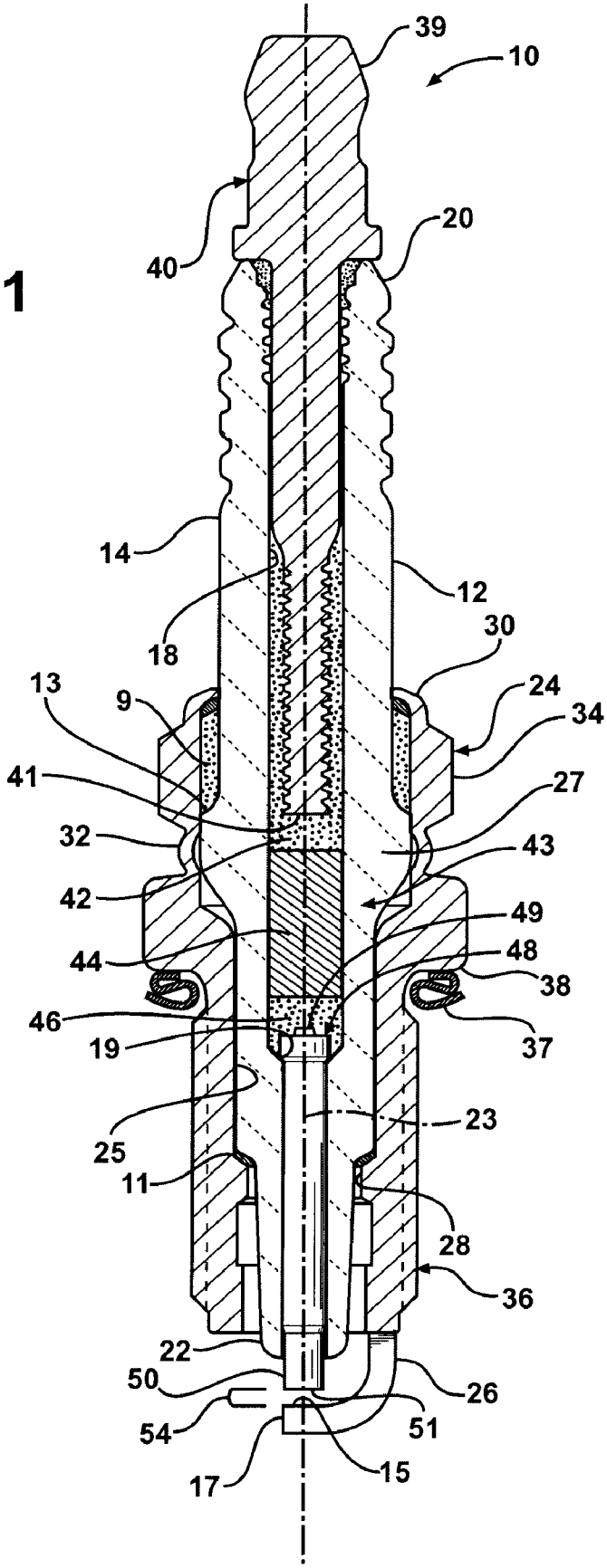
FIG. 1 is a partial cross-sectional view of a spark plug including center and ground electrodes manufactured in accordance with one presently preferred aspect of the invention.

Referring in more detail to the drawings, FIG. 1 illustrates a spark ignition device used for igniting a fuel/air mixture having an electrode manufactured in accordance with the invention. The electrode may be used in any suitable spark ignition device, including various configurations of spark plugs, igniters and the like, but is particularly adapted for use in various spark plug electrode configurations. The electrodes of an ignition device such as a spark plug are essential to the function of the device. In spark ignition devices, such as spark plugs, the material used for the electrodes are exposed to the most extreme temperature, pressure, chemical corrosion and physical erosion conditions experienced by the device. These include exposure of the electrode alloys to numerous high temperature chemical reactant species associated with the combustion process which promote oxidation, sulfidation and other high temperature corrosion processes, such as those attributed to calcium and phosphorus in the combustion products, as well as reaction of the plasma associated with the spark kernel and flame front which promote erosion of the spark surfaces of the electrodes. The electrodes are also subject to thermo-mechanical stresses associated with the cyclic exposure to extreme temperatures, particularly to the extent corrosion processes form corrosion products on the electrode surfaces having different physical and mechanical properties, such as coefficients of thermal expansion, than the electrode alloy. Also there can be additional cyclic thermo-mechanical stresses associated with the mismatch in the thermal expansion coefficients of the electrode materials and associated components such as the insulator or shell which can result in various high temperature creep deformation, cracking and fracture phenomena, resulting in failure of the electrodes. All of these represent processes by which the properties of the electrodes may be degraded, and in particular, they can result in changes in the spark gap, and thus, the formation, location, shape, duration and other characteristics of the spark, which in turn affects the combustion characteristics of the fuel/air mixture and performance characteristics of the engine or other combustion device in which the spark ignition device is incorporated. The present invention has improved resistance to these degradation processes over that of commonly used electrode alloys, such as various UNS N06600 alloys, including those sold under the trademarks Inconel® 600, Ferrochronin® 600, Nichrofer® 7615 and the like which are frequently used as center and ground electrode materials for spark plugs.

In FIG. 1, a spark plug having electrodes in accordance with the subject invention is generally illustrated at 10. The spark plug 10 includes a generally annular ceramic insulator, generally indicated at 12, which may include aluminum oxide or another suitable electrically insulating material having a specified dielectric strength, high mechanical strength, high thermal conductivity, and excellent resistance to thermal shock. The insulator 12 may be press molded from a ceramic powder in a green state and then sintered at a high temperature sufficient to densify and sinter the ceramic powder. The insulator 12 has an outer surface which may include a partially exposed upper portion or mast portion 14 to which a rubber or other insulating spark plug boot (not shown) surrounds and grips to electrically isolate an electrical connection of the terminal end 20 of the spark plug with an ignition wire and system (not shown). The exposed mast portion 14 may include a series of ribs or other surface glazing or features to provide added protection against spark or secondary voltage flash-over and to improve the gripping action of the mast portion with the spark plug boot. The insulator 12 is of generally tubular or annular construction, including a central passage 18 extending longitudinally between the upper terminal end 20 and a lower core nose end 22 along a central axis 23. The central passage 18 generally has a varying cross-sectional area, generally greatest at or adjacent the terminal end 20 and smallest at or adjacent the core nose end 22, with an intermediate shoulder 19 therebetween, but other passage configurations are possible in accordance with the invention.

An electrically conductive metal shell is generally indicated at 24. The shell 24 may be made from any suitable metal, including various coated and uncoated steel alloys. The shell 24 has a generally annular interior surface 25 which surrounds and is adapted for sealing engagement with the exterior surface of mid and lower portions 27 of the insulator 12 and includes at least one attached ground electrode 26 which is maintained at ground potential. While ground electrode 26 is depicted in a commonly used single L-shaped style, it will be appreciated that multiple ground electrodes of straight, bent, annular, trochoidal and other configurations can be substituted depending upon the intended application for the spark plug 10, including two, three and four ground electrode configurations, and those where the electrodes are joined together by annular rings and other structures used to achieve particular sparking surface configurations. The ground electrode 26 has one or more ground electrode sparking surface 15, on a sparking end 17 proximate to and partially bounding a spark gap 54 located between the ground electrode 26 and a center electrode 48, which also has an associated center electrode sparking surface 51. The spark gap 54 may constitute an end gap, side gap or surface gap, or combinations thereof, depending on the relative orientation of the electrodes and their respective sparking ends and surfaces. The ground electrode sparking surface 15 and center electrode sparking surface 51 may each have any suitable cross-sectional shape, including round, rectangular, square and other shapes, and the shapes of these sparking surfaces may be different from one another.

The shell 24 is generally tubular or annular in its body section and includes an internal lower compression flange 28 adapted to bear in pressing contact against a small mating lower shoulder 11 of the insulator 12. The shell 24 generally also includes an upper compression flange 30, which is crimped or formed over during the assembly operation to bear on a large upper shoulder 13 of the insulator 12, wherein the bearing is facilitated via an intermediate packing material 9. The shell 24 may also include a deformable zone 32 which is designed and adapted to collapse axially and radially outwardly in response to heating of the deformable zone 32 and associated application of an overwhelming axial compressive force during or subsequent to the deformation of the upper compression flange 30 in order to hold the shell 24 in a fixed axial position with respect to the insulator 12 and form a gas tight radial seal between the insulator 12 and the shell 24. Gaskets, cement, or other packing or sealing compounds can also be interposed between the insulator 12 and the shell 24 to perfect a gas-tight seal and to improve the structural integrity of the assembled spark plug 10.

The shell 24 may be provided with a tool receiving hexagon 34 or other feature for removal and installation of the spark plug in a combustion chamber opening. The feature size will preferably conform with an industry standard tool size of this type for the related application. Of course, some applications may call for a tool receiving interface other than a hexagon, such as slots to receive a spanner wrench, or other features such as are known in racing spark plug and other applications. A threaded section 36 is formed on the lower portion of the metal shell 24, immediately below a sealing seat 38. The sealing seat 38 may be paired with a gasket 37 to provide a suitable interface against which the spark plug 10 seats and provides a hot gas seal of the space between the outer surface of the shell 24 and the threaded bore in the combustion chamber opening. Alternately, the sealing seat 38 may be designed as a tapered seat located along the lower portion of the shell 24 to provide a close tolerance and a self-sealing installation in a cylinder head which is also designed with a mating taper for this style of spark plug seat.

An electrically conductive terminal stud 40 is partially disposed in the central passage 18 of the insulator 12 and extends longitudinally from an exposed top post 39 to a bottom end 41 embedded partway down the central passage 18. The top post 39 is configured for operable connection to an ignition wire (not shown) which is typically embedded in an electrically isolating boot as described herein and receives timed discharges of high voltage electricity required to fire the spark plug 10 by generating a spark in the spark gap 54.

The bottom end 41 of the terminal stud 40 is embedded within a conductive glass seal 42, forming the top layer of a composite three-layer suppressor-seal pack 43. The conductive glass seal 42 functions to seal the bottom end of the terminal stud 40 and electrically connect it to a resistor layer 44. This resistor layer 44, which comprises the center layer of the three-layer suppressor-seal pack 43, can be made from any suitable composition known to reduce electromagnetic interference ("EMI"). Depending upon the recommended installation and the type of ignition system used, such resistor layers 44 may be designed to function as a more traditional resistor-suppressor or, in the alternative, as an inductive-suppressor, or a combination thereof. Immediately below the resistor layer 44, another conductive glass seal 46 establishes the bottom or lower layer of the suppressor-seal pack 43 and electrically connects the terminal stud 40 and suppressor-seal pack 43 to the center electrode 48. The top layer 42 and bottom layer 46 may be made from the same conductive material or different conductive materials. Many other configurations of glass and other seals, and various other types and configurations of EMI suppressors are well-known and may also be used in accordance with the invention. Accordingly, electrical charge from the ignition system travels through the bottom end of the terminal stud 40 to the top layer conductive glass seal 42, through the resistor layer 44, and into the lower conductive glass seal layer 46.

The conductive center electrode 48 is partially disposed in the central passage 18 and extends longitudinally from its upper end or head 49, which is encased in the lower glass seal layer 46, to its lower end or sparking end 50 proximate the ground electrode 26. The suppressor-seal pack 43 electrically interconnects the terminal stud 40 and center electrode 48, while simultaneously sealing the central passage 18 from combustion gas leakage and also suppressing radio frequency noise emissions from the spark plug 10 during its operation. As shown, center electrode 48 is preferably a one-piece monolithic structure extending continuously and uninterrupted between its head 49 and its sparking end 50. The center electrode sparking surface 51 is located on sparking end 50 and is located opposite the ground electrode sparking surface 15, thereby forming the spark gap 54 in the intermediate space between them. It will be readily understood and within the scope of this invention that the polarity of the center electrode 48 during operation of the spark plug 10 may be either positive or negative such that the center electrode 48 has a potential which is either higher or lower than ground potential.

Preferably both, but at least one, of the center and ground electrodes 48, 26 are fabricated from the conductive ceramic materials described below which have improved resistance to the degradation processes described above, such as over that of Ni-based alloy formulations, for example. The general category of conductive ceramic materials to which this invention applies may be referred to generally as transition metal nitrides, carbides and carbonitrides due to their superior high temperature properties, including mechanical strength and resistance to certain high temperature oxidation, erosion and corrosion processes. Specifically, the invention includes conductive ceramics of the form $M_{n+1}AX_n$, where M is a transition metal, A is a group IIIA or IVA element, and X is nitrogen, or carbon, or both carbon and nitrogen. While M may be any transition metal suitable for forming a conductive ceramic compound of the form described above, it is preferred that M be selected from a group consisting of Ti, Nb, Ta, V, Cr, Mo, Sc, Zr and Hf. Even more preferably, M may include Ti, Nb, Ta, V, and Cr, in various combinations. A may be any suitable group IIIA or IVA element or elements, including Al, Ga, In, Tl, Si, Ge, Sn, Pb, P, As and S, with Al and Si believed to be particularly preferred. X may be carbon, nitrogen or both carbon and nitrogen in various stoichiometric and non-stoichiometric proportions.

Exemplary ceramics of the invention useful for spark ignition device electrodes include conductive ceramics of the form $M_{n+1}Ax_n$. Examples of ceramic materials of this form include $Ti_2AlC$, $Ti_2AlN$, $Ti_2Al(C_{0.5}, N_{0.5})$, $Nb_2AlC$, (Nb, Ti)AlC, $Ti_2AlC$, $V_2AlC$, $Cr_2AlC$, $Ti_4AlN_3$, $Ti_3AlC_2$, $Ti_2GaC$, $V_2GaC$, $Cr_2GaC$, $Nb_2GaC$, $Mo_2GaC$, $Ta_2GaN$, $Cr_2GaN$, $Sc_2InC$, $Ti_2InC$, $Zr_2InC$, $Nb_2InC$, $Hf_2InC$, $Ti_2InN$, $Zr_2InN$, $Ti_2TlC$, $Zr_2TlC$, $Hf_2TlC$, $Zr_2TlN$, $Ti_3SiC_2$, $Ti_2GeC$, $V_2GeC$, $Cr_2GeC$, $Ti_3GeC_2$, $Ti_2SnC$, $Zr_2SnC$, $Hf_2SnC$, $Hf_2SnN$, $Ti_2PbC$, $Zr_2PbC$, $Hf_2PbC$, $V_2PC$, $Nb_2PC$, $V_2AsC$, $Nb_2AsC$, $Ti_2SC$, $Zr_2SC$, $Nb_2SC$, and $Hf_2SC$. Of these (Nb, Ti)AlC, $Ti_2AlC$, $Va_2AlC$, $Cr_2AlC$, $Ti_4AlN_3$, $Ti_3AlC_2$ and $Ti_3SiC_2$ are believed to be preferred, with $Ti_3SiC_2$ and $Ti_2AlC$ believed to be particularly preferred.

While the subject conductive ceramic material has been described for use in the particular application of the ground and/or center electrodes 26, 48 for a spark plug 10, it will be appreciated that other uses and applications for the conductive ceramic electrodes for other spark ignition devices will be readily appreciated by those of skill in the art due to the invented material's superior resistance to high temperature oxidation, erosion and corrosion, high temperature mechanical strength, and improvements in resistance to cracking and fracture due to thermo-mechanically induced stresses, particularly weld attachments associated with various prior firing tip/electrode configurations. While the exemplary embodiment of FIG. 1 illustrates a single center and ground electrode configuration, the invention encompasses both multiple center electrode and ground electrode configurations.

Figure 2:
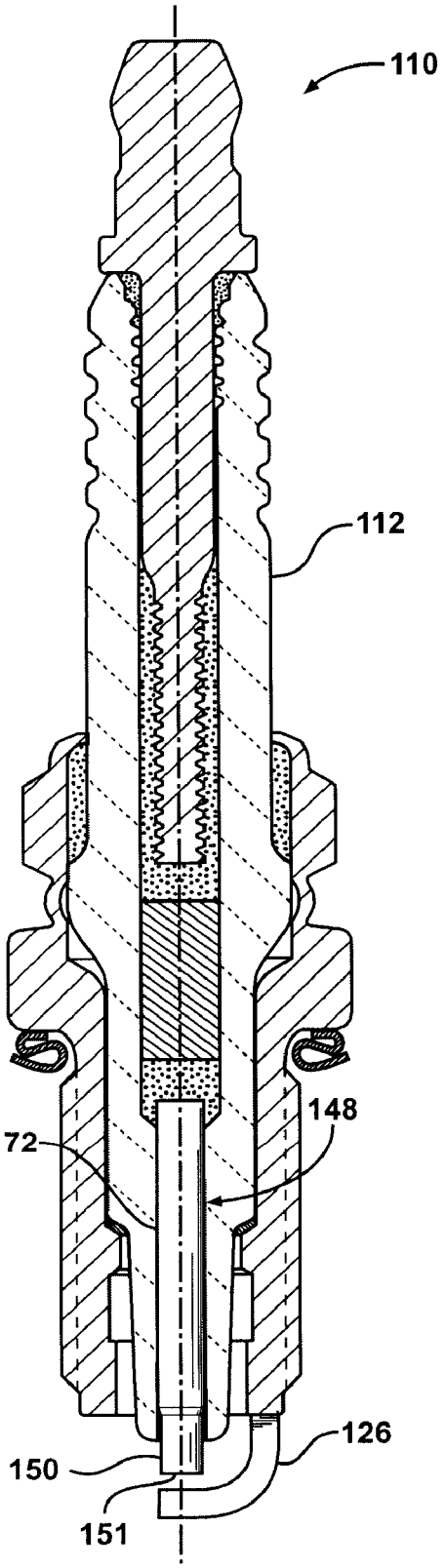
FIG. 2 is a partial cross-sectional view of a spark plug constructed in accordance with another presently preferred aspect of the invention.
Figure 3:
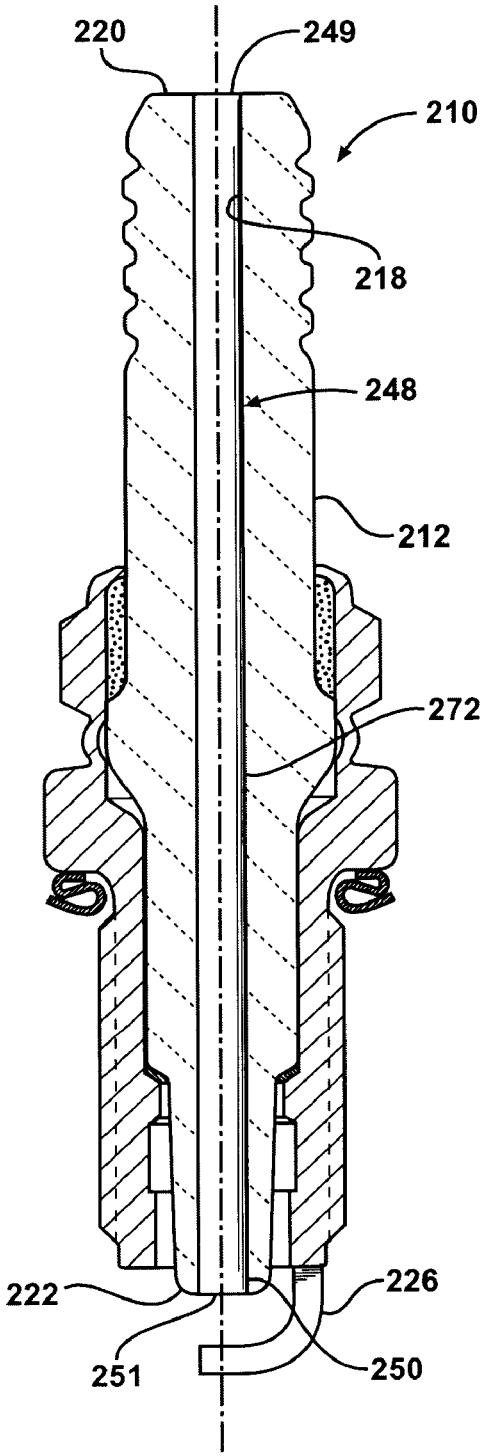
FIG. 3 is a partial cross-sectional view of a spark plug constructed in accordance with yet another presently preferred aspect of the invention.

While the center electrode 48 illustrated may be described as a headed pin configuration due to the flared upper end or head 49, the invention also encompasses all manner of headed arrangements with the head at the opposite end of the electrode (i.e., proximate the sparking end 50). In addition, as illustrated in FIG. 2, wherein reference numerals offset by a factor of 100 are used to identify similar features as described above, an electrode 148 of a spark plug 110 can be constructed as straight cylindrical configuration, thereby being well suited to be formed in an extruding process and co-fired or sintered along with an insulator 112 to permanently bond the electrode 148 to the insulator ceramic material via an as sintered bond represented generally at 72. Accordingly, the insulator 112 and electrode 148 can be constructed as a unitary subassembly that is economical in manufacture. In addition, as illustrated in FIG. 3, wherein reference numerals offset by a factor of 200 are used to identify similar features as described above, an electrode 248 of a spark plug 210 can be constructed as a straight cylindrical configuration having an outer surface with a constant or substantially constant diameter extending over a length sufficient to extend through the entire length of a central passage 218 within an insulator 212 of the spark plug. Accordingly, the central passage 218 of the insulator 212 can be formed as a cylindrical though passage of a constant or substantially constant diameter, and sized for close, pressing receipt of the electrode 248, wherein the opposite ends 249, 250 of the electrode 248 are flush or substantially flush with the opposite terminal and nose ends 220, 222 of the insulator 212. Accordingly, the spark plug 210 does not have the conventional central resistor layer and glass sealing, as the electrode 248 extends completely through the passage 218 and performs the desired electrical resistance, depending on the ceramic material used to construct the electrode 248. Further, as with the electrode 148, the electrode 248 can be co-fired or sintered with the insulator 212 to permanently bond the electrode 248 to the insulator ceramic material via an as sintered bond represented generally at 272. Accordingly, the insulator 212 and electrode 248 can be constructed as a unitary subassembly that is economical in manufacture. It should be recognized that as well as those configurations illustrated, that the diameter of the electrode can be constructed to vary along its length, either in a stepwise, tapered or other manner, as desired. The center electrode 48, 148, 248 may have any suitable cross-sectional size or shape, including circular, square, rectangular, or otherwise or size. Further, the sparking end 50, 150, 250 may have any suitable shape. It may have a reduced cross-sectional size, and may have a cross-sectional shape that is different than the other portions of the center electrode. The sparking surface 51, 151, 251 may be any suitable shape, including flat, curved, tapered, pointed, faceted or otherwise.

The center electrode may have any suitable cross-sectional size and/or shape, including but not limited to circular, square and rectangular or combinations thereof. Further, the sparking end may have any suitable shape that is the same or different than that of other portions of the center electrode and may have a reduced cross-sectional size. The sparking surface of the center electrode may be any suitable shape, including flat, curved, tapered, pointed, faceted or otherwise.

The electrodes 26, 126, 226, 48, 148, 248 of the invention may be made using any suitable method for making ceramic articles of the types described, including injection molding and sintering, extrusion and sintering or pressing and sintering.

Obviously, many modifications and variations of the present invention are possible in light of the above teachings. It is, therefore, to be understood that within the scope of the appended claims, the invention may be practiced otherwise than as specifically described.

What is claimed is:

1. An electrode for a spark ignition device, said electrode comprising a conductive ceramic of the form $M_{n+1}AX_n$, where M is a transition metal, n is 1, 2, or 3, A is an element selected from a group IIIA element, a group IVA element, Al, Ga, In, Tl, Si, Ge, Sn, Pb, P, As and S, and X is nitrogen, or carbon, or both carbon and nitrogen.

2. The electrode of claim 1, wherein M is a transition metal selected from the group consisting of Ti, Nb, Ta, V, Cr, Mo, Sc, Zr and Hf.

3. The electrode of claim 2, wherein A is selected from a group consisting of Al, Ga, In, Tl, Si, Ge, Sn, Pb, P, As and S.

4. The electrode of claim 1, wherein said conductive ceramic is selected from a group consisting of $Ti_2AlC$, $Ti_2AlN$, $Ti_2Al(C_{0.5}, N_{0.5})$, $Nb_2AlC$, (Nb, Ti)AlC, $Ta_2AlC$, $V_2AlC$, $Cr_2AlC$, $Ti_4AlN_3$, $Ti_3AlC_2$ and $Ti_3SiC_2$.

5. The electrode of claim 4, wherein said conductive ceramic is $Ti_3SiC_2$.

6. The electrode of claim 4, wherein said conductive ceramic is $Ti_3AlC_2$.

7. The electrode of claim 1, wherein said spark ignition device is a spark plug, further comprising:

a generally annular ceramic insulator;

a conductive shell surrounding at least a portion of said ceramic insulator; and wherein said electrode is at least one of a center electrode disposed in said ceramic insulator, said center electrode having a terminal end and a sparking end with a center electrode sparking surface and a ground electrode operatively attached to said shell, said ground electrode having a ground electrode sparking surface located proximate said center electrode sparking surface, said center electrode sparking surface and said ground electrode sparking surface defining a spark gap therebetween.

8. The electrode of claim 7, wherein said electrode is said center electrode.

9. The electrode of claim 8, wherein said electrode is disposed in said ceramic insulator by operation of a glass seal which contacts said terminal end.

10. The electrode of claim 7, wherein said electrode is said ground electrode.

11. A spark plug, comprising:

a ceramic insulator;

a conductive shell surrounding at least a portion of said ceramic insulator;

a center electrode disposed in said ceramic insulator, said center electrode having a sparking end with a center electrode sparking surface;

a ground electrode operatively attached to said shell, said ground electrode having a ground electrode sparking surface located proximate said center electrode sparking surface, said center electrode sparking surface and said ground electrode sparking surface providing a spark gap therebetween; and wherein at least one of said center electrode or said ground electrode is a conductive ceramic of the form $M_{n+1}AX_n$, where M is a transition metal, n is 1, 2, or 3, A is at least one of a group IIIA element, a group IVA element, Al, Ga, In, Tl, Si, Ge, Sn, Pb, P, As and S, and X is nitrogen, or carbon, or both carbon and nitrogen.

12. The spark plug of claim 11, wherein M is a transition metal selected from the group consisting of Ti, Nb, Ta, V, Cr, Mo, Sc, Zr and Hf.

13. The spark plug of claim 12, wherein A is selected from a group consisting of Al, Ga, In, Tl, Si, Ge, Sn, Pb, P, As and S.

14. The spark plug of claim 11, wherein said conductive ceramic is selected from a group consisting of $Ti_2AlC$, $Ti_2AlN$, $Ti_2Al(C_{0.5}, N_{0.5})$, $Nb_2AlC$, (Nb, Ti)AlC, $Ta_2AlC$, $V_2AlC$, $Cr_2AlC$, $Ti_4AlN_3$, $Ti_3AlC_2$ and $Ti_3SiC_2$.

15. The spark plug of claim 14, wherein said conductive ceramic is $Ti_3SiC_2$.

16. The spark plug of claim 14, wherein said conductive ceramic is $Ti_3AlC_2$.

* * * * *